United States Patent [19]

Weiss et al.

[11] Patent Number: 5,048,711

[45] Date of Patent: Sep. 17, 1991

[54] LABEL INDICATOR FOR SCREW THREAD CLOSURE AND METHOD OF USE

[75] Inventors: Harvey S. Weiss, Buffalo Grove; Lawrence G. Ponsi, Wheeling, both of Ill.

[73] Assignee: Sage Products, Inc., Cary, Ill.

[21] Appl. No.: 545,367

[22] Filed: Jun. 28, 1990

[51] Int. Cl.[5] ..... B65D 55/00; G09F 9/00

[52] U.S. Cl. ..... 220/214; 40/311; 116/309; 206/459; 215/230; 215/252

[58] Field of Search ..... 215/203, 206, 230, 250, 215/252; 206/459, 807; 116/308-309; 40/310, 311; 220/214, 288

[56] References Cited

U.S. PATENT DOCUMENTS

| | | | |
|---|---|---|---|
| 207,627 | 9/1878 | Shaw | 220/214 |
| 274,745 | 3/1883 | Evans | 220/214 |
| 589,406 | 9/1897 | Braly | 215/230 X |
| 1,268,213 | 6/1918 | Cameron | 40/311 |
| 2,201,205 | 5/1940 | Samburg | 215/230 |
| 2,201,791 | 5/1940 | Samburg | 215/230 |
| 2,272,262 | 2/1942 | Carter | 40/311 |
| 2,414,420 | 1/1947 | Sebell | 215/230 X |
| 3,139,064 | 6/1964 | Harle | 116/309 |
| 4,037,559 | 7/1977 | Hopkins et al. | 116/309 |
| 4,964,512 | 10/1990 | Ingram et al. | 206/459 |
| 4,964,513 | 10/1990 | Ingram et al. | 206/459 |

*Primary Examiner*—Bryon P. Gehman

*Attorney, Agent, or Firm*—Lee, Mann, Smith, McWilliams & Sweeney

[57] ABSTRACT

A container system and method for indicating the proper orientation of the closure of a container. The system comprises a container and rotatable closure, and a label applied in an overlapping relation to the closure and container. The label has an area which can be separated, and alignment indicators on the two segments of the label which are unaligned. In use, after the label has been applied, the closure is removed by unscrewing, breaking the label. Thereafter, when the closure is reapplied, the closure is overtightened to align the previously unaligned alignment indicators of the label to insure a leak-free containeer system after the closure has been reapplied.

16 Claims, 1 Drawing Sheet

LABEL INDICATOR FOR SCREW THREAD CLOSURE AND METHOD OF USE

BACKGROUND OF THE INVENTION

Figure 1:
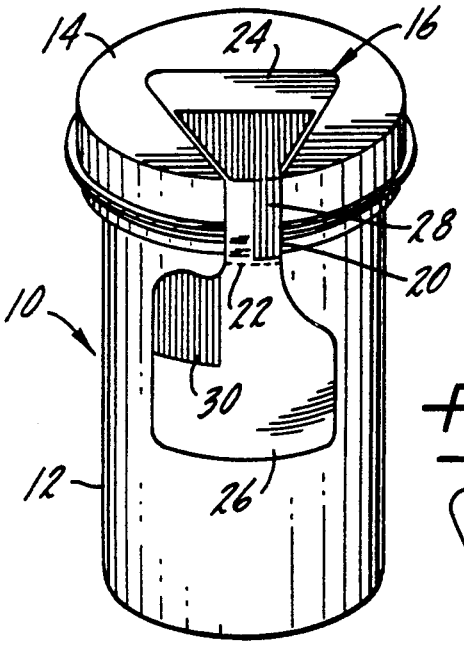

This invention relates to a container system and process, and in particular to a container system and process for specimen containers where a degree of assurance is built into the system so that the closure for the container, when reapplied, forms a leak-tight seal.

The container of the invention is used typically for collecting urine samples and the like. Previous to the invention, for collection of a sample, a sterile container, with the closure applied, is given to the patient who removes the closure and then, after depositing the specimen, reapplies the closure. Typically, there is no indication on the container or closure as to the tightness required for forming an appropriate seal between the closure and the container. As a result, the patient guesses as to required tightness, and sometimes the closures are applied with appropriate force to provide a leak-free seal, but more often, the closures are either overtightened, thus making their removal difficult, or undertightened, allowing leakage and contamination. It is undertightened closures that are most dangerous and are the subject to which this invention is primarily directed.

Other types of containers have been used for urine collection, but are often complex and therefore commensurately expensive, or have different types of closures, which do not seal well or promote spilling when opened. Rotatable closures which can be easily screwed onto and unscrewed from a container have been found to be the most desirable types of closures for specimen collection.

SUMMARY OF THE INVENTION

The invention provides both a container system for and a method of indicating the proper orientation of a screw thread closure on a container. The system comprises a container having a rotatable screw thread closure thereon. A label is applied in an overlapping relation to the closure and the container, with the label having a severable area located at a junction of the closure and the container. The label has a first alignment indicator on one segment of the label and a second alignment indicator on a second segment of the label, and the severable area is located between the two label segments. One of the segments adheres to the closure and the other of the segments adheres to the container. The alignment indicators are unaligned with one another when the label is not severed.

In accordance with the preferred from of the invention, the severable area of the label includes a score to promote severing along the score when the closure is removed from the container. Preferably, the first and second alignment indicators each comprise a colored bar, with the bars being offset from one another when the label is not severed. One of the bars is greater in width than the other of the bars to permit alignment of the bars over several degrees of rotation of the closure.

Each of the bars preferably includes alignment indicia. The alignment indicia can be alignable arrows, or can be alignable lines, dashes or dots. If alignment indicia is used, color may or may not be used in addition thereto, depending on the desired use of the container.

In use, the closure is applied to the container, and the label is then applied to the closure and container in an overlapping relation, with the severable area or being located at a junction of the closure and the container. Unscrewing the closure breaks the label at the severable area into two segments, one segment adhering to the closure and the second segment adhering to the container. When the closure is reapplied to the container, the closure is overtightened to align the previously unaligned alignment indicators.

The alignment indicators are circumferentially offset from one another when the label is applied to the closed container and closure. When the closure is unscrewed, the first alignment indicator is displaced circumferentially away from the second alignment indicator as the label is broken at the severable area.

BRIEF DESCRIPTION OF THE DRAWING FIGURES

Figure 2:
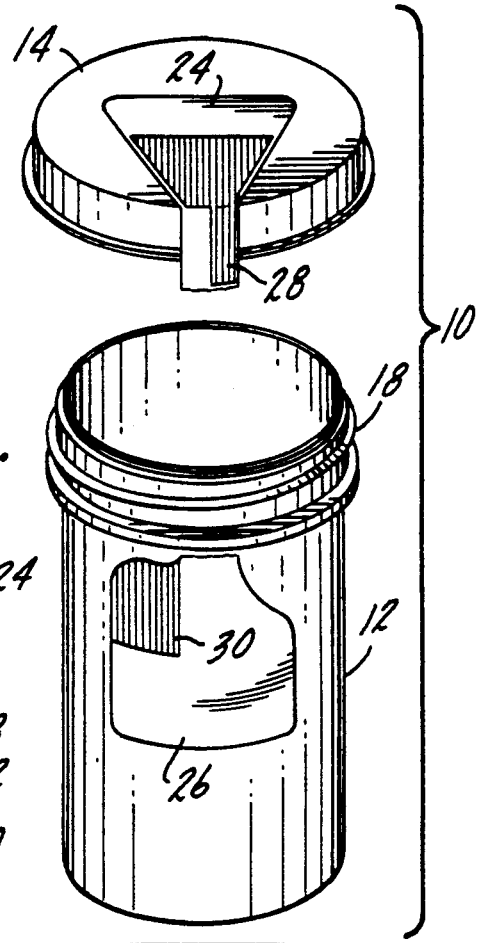
Figure 4:
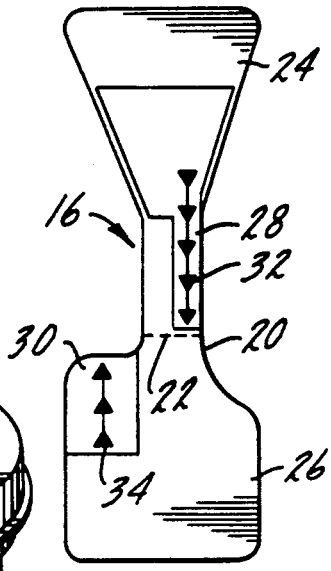
Figure 3:
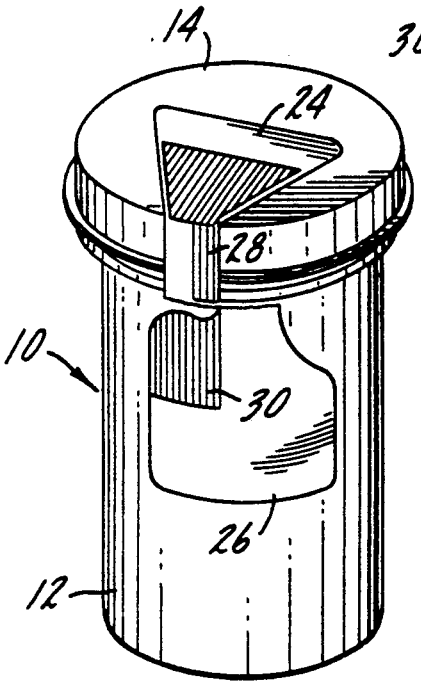
Figure 5:
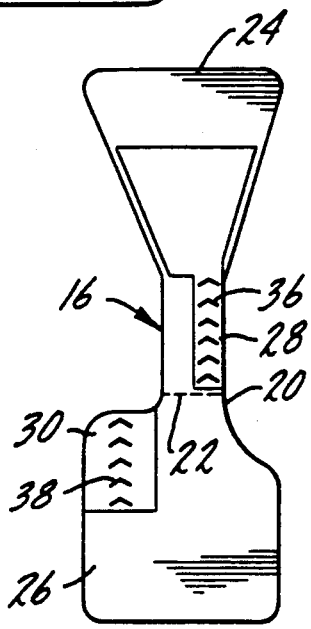
Figure 6:
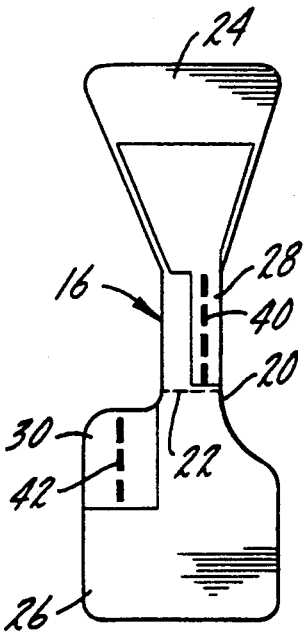

FIG. 1 is a perspective view of a container system according to the invention, with the closure applied to the container and the label unsevered, FIG. 2 is a perspective view similar to FIG. 1, but with the closure removed, and with the label severed, FIG. 3 is a perspective view of the container system of FIG. 2 with the closure reapplied and overtightened to align the alignment indicators of the label, FIG. 4 is a plan view of one form of label according to the invention, FIG. 5 is a plan view of a second form of label according to the invention, and FIG. 6 is a plan view of a third form of label according to the invention.

DESCRIPTION OF EXAMPLES EMBODYING THE BEST MODE OF THE INVENTION

A container system according to the invention is designated generally at 10 in the drawing figures. The container system comprises a container 12, a closure 14, and a label 16 applied to the container 12 and closure 14. As best shown in FIG. 2, the container 12 includes a screw thread 18 and the closure 14 includes complementary threading (not illustrated) for application of the closure to the container by rotary screw threading.

The label 16 has a severable area 20, and in the preferred from of the invention, has a score 22 to promote severing across the severable area 20. The label 16 is divided into two segments, one on either side of the severable area 20, a first segment 24 which is applied to the closure 14, and a second segment 26 which is applied to the container 12. As shown in FIG. 1, with the label 16 properly applied to the container 12 and closure 14, the score 22 is located at approximately the visible junction of the closure 14 and container 12.

The first label segment 24 includes a first alignment indicator 28. The second label segment 26 includes a second alignment indicator 30. When the label 16 is unsevered, the alignment indicators 28 and 30 are unaligned, the indicator 28 being, when the label 16 is applied to the container 12 and closure 14, circumferentially offset from the indicator 30.

The indicators 28 and 30 may be colored or otherwise provided with alignment indicia. As shown in FIGS. 1 through 3, the indicators 28 and 30 are colored. In FIG. 4, the alignment indicators 28 and 30 include alignment indicia in the form of arrows 32 and 34 aimed toward one another. In FIG. 5, the alignment indicators 28 and 30 include indicia in the form of arrowheads 36 and 38 oriented in one direction. In the form of FIG. 6, the alignment indicators 28 and 30 include alignment indicia in the form of lines, dots or dashes 40 and 42.

In all forms of the invention, the labels 16 are substantially identical, with a score 22 to promote easy severing. The alignment indicators 28 and 30 are the same in shape, varying only in color and being with or without alignment indicia, such as arrows, lines, dots or dashes, as needs dictate.

The width of the second alignment indicator 30 is, as illustrated in the drawing figures, considerably greater than the width of the first alignment indicator 28. This allows greater latitude of alignment of the alignment indicators 28 and 30 when the container system 10 is used, as explained further below.

The closure 14 may be conventional and have an inner seal or sealing ring (not illustrated), so that when the closure 14 is applied to the container 12, a leak-tight seal is formed. Other types of sealing may be employed in a conventional fashion.

The container system according to the invention is assembled initially empty. After the container 12, closure 14 and label 16 have been fabricated, the closure 14 is applied to the container 12. The label 16, preferably having an adhesive back, is then applied as shown in FIG. 1, overlapping the closure 14 and container 12 so that the score 22 is located at the visible junction of the closure 14 and container 12. If sterilization is desired, the container system can then be sterilized in any conventional fashion.

When the closure 14 is removed from the container 12, the label 16 is severed at the score 22, as shown in FIG. 2. Simply unscrewing of the closure 14 breaks the label at the score 22, leaving the first segment 24 adhering to the closure 14 and the second segment 26 adhering to the container 12 Thereafter, the container 12 is filled or used for specimen collection, as needs dictate. Then, the closure 14 is reapplied to the container 12, but instead of simply realigning the severed portions at the score 22, the closure 14 is overtightened, aligning the first alignment indicator 28 with the second alignment indicator 30. Since the alignment indicator 30 is wider than the alignment indicator 28, overtightening need not be absolutely precise for alignment, thus allowing several degrees of flexibility while tightening, but still promoting a leak-free seal. If the label 16 includes alignment indicia such as the arrows 32 and 34, arrowheads 36 and 38, or lines, dots or dashes 40 and 42, overtightening can be to the extent of approximately aligning the alignment indicia.

The invention provides a simple yet effective container system for assuring a leak-tight resealing of the container 12 and closure 14. The closure 14 is normally machine applied to the container 12 during initial assembly, with the label then applied to the combination. Once the closure 14 is removed, even if it is reapplied to the extent of the same orientation as when machine applied, there is no assurance that the resealed container will be leak-proof. However, with the label 16, an effective assurance is provided by the requirement of the necessary overtightening of the closure 14 on the container 12 to align the previously unaligned alignment indicators 28 and 30.

Not only does the label 16 provide an effective guide for resealing of the closure 14 on the container, but also the label provides a visual indicator of breaking of the seal of the container 12 and closure 14, thus evidencing tampering or loss of sterility. An unbroken label will assure a patient that the container is clean and free for use, while a severed label that has the alignment indicators 28 and 30 appropriately aligned assures the laboratory technician that the encapsulated sample is contained in a leak proof fashion, and the container system 10 can be handled without fear of splashing, spilling or contaminating the sample therewithin.

Various changes can be made to the invention without departing from the spirit thereof or scope of the following claims.

What is claimed is:

1. A method of indicating the proper orientation of a screw-thread closure of a container, comprising the steps of (a) initially applying the closure to the container, (b) selecting a label having a severable area, and having a first alignment indicator on one segment and a second alignment indicator on a second segment, said severable area being located between said segments and said indicators being unaligned with one another, (c) applying the label in an overlapping relation to said closure and said container such that the label adheres to both the container and the closure with the severable area being located at a junction of said closure and said container, (d) removing the closure and breaking the label at the severable area into said two segments, one segment adhering to the closure and the second segment adhering to the container, and (e) reapplying the closure to the container and overtightening the closure to align said previously unaligned indicators.

2. A method according to claim 1 in which said first alignment indicator is circumferentially offset from said second alignment indicator in method step (c) such as when method step (d) is begun, said first alignment indicator is displaced from said second alignment indicator.

3. A method according to claim 1 in which said severable area includes a score, and in which method step "d" includes breaking the label at said score.

4. A method of indicating the proper orientation of a screw thread closure of a reclosed container, comprising the steps of:

(a) selecting a container having a screw thread closure thereon and a label applied in an overlapping relation such that the label adheres to both the container and the closure with a severable area of the label being located at a junction of said closure and said container, the label further including a first alignment indicator on one segment and a second alignment indicator on a second segment, said severable area being located between said indicators and said indicators being offset from one another, (b) removing the closure and breaking the label at the severable area into said two segments, one segment adhering to the closure and the second segment adhering adhering to the closure and the second segment adhering to the container, and (c) reapplying the closure to the container and overtightening the closure to align said previously unaligned indicators.

5. A method according to claim 4 in which said first alignment indicator is circumferentially offset from said second alignment indicator in method step (a) such that when method step (b) is begun, said first alignment indicator is displaced from said second alignment indicator.

6. A method according to claim 4 in which said severable area includes a score, and in which method step (b) includes breaking the label at said score.

7. A container system for indicating the proper orientation of a screw thread closure on a container, comprising (a) a container having a screw thread closure thereon, (b) a label applied in an overlapping relation to said closure and said container, said label having a severable area located at a junction of said closure and said container, said label further having a first alignment indicator on one segment of said label and a second alignment indicator on a second segment of said label, said severable area being located between said segments with one of said segments adhering to said closure and the other of said segments adhering to said container, and said alignment indicators being unaligned with one another.

8. A container system according to claim 7 in which said severable area includes a score.

9. A container system according to claim 7 in which said first and second alignment indicators each comprise a colored bar, said bars being offset from one another.

10. A container system according to claim 9 in which one of said bars is greater in width than the other of said bars.

11. A container system according to claim 9 in which each said bar includes alignment indicia.

12. A container system according to claim 11 in which said alignment indicia comprises alignable arrows.

13. A container system according to claim 11 in which said alignment indicia is selected from the group comprising alignable lines, dashes and dots.

14. A container system according to claim 7 in which said first and second alignment indicators each comprise alignment indicia.

15. A container system according to claim 14 in which said alignment indicia comprises alignable arrows.

16. A container system according to claim 14 in which said alignment indicia is selected from the group comprising alignable lines, dashes and dots.

* * * * *

UNITED STATES PATENT AND TRADEMARK OFFICE

CERTIFICATE OF CORRECTION

PATENT NO. : 5,048,711

DATED : September 17, 1991

INVENTOR(S) : Harvey S. Weiss, Lawrence G. Ponsi

It is certified that error appears in the above-identified patent and that said Letters Patent is hereby corrected as shown below:

In Claim 4(b), Column 4, Lines 60-61 delete:

adhering to the closure and the second segment adhering

Signed and Sealed this

Sixth Day of July, 1993

Attest:

Michael K. Kirk

MICHAEL K. KIRK

Attesting Officer

Acting Commissioner of Patents and Trademarks